United States Patent [19]

Moser et al.

[11] 3,941,262

[45] Mar. 2, 1976

[54] PIVOTALLY DISPOSABLE BUCKET

[75] Inventors: Raymond L. Moser, Tremont; Everette Michael Volle, Morton, both of Ill.

[73] Assignee: Caterpillar Tractor Co., Peoria, Ill.

[22] Filed: Feb. 1, 1974

[21] Appl. No.: 438,669

[52] U.S. Cl. ..... 214/145 R; 37/118 R

[51] Int. Cl.[2] ..... E02F 3/81

[58] Field of Search ..... 214/145, 131 A, 620, 768; 37/118 R, 118 A, 141 R; 172/664

[56] References Cited

UNITED STATES PATENTS

| | | | |
|---|---|---|---|
| 872,439 | 12/1907 | Livengood | 37/141 |
| 3,014,293 | 12/1961 | Boatman et al. | 37/141 |
| 3,039,631 | 6/1962 | Baker | 214/768 |
| 3,182,831 | 5/1965 | Bergmann | 214/768 |
| 3,238,648 | 3/1966 | Cobb et al. | 172/664 |
| 3,512,283 | 5/1970 | Moody et al. | 214/768 |
| 3,700,132 | 10/1972 | Waters | 214/768 |
| 3,749,262 | 7/1973 | Stark | 214/145 |
| 3,775,879 | 12/1973 | Quick | 37/118 |
| 3,805,422 | 4/1974 | Stepe | 214/145 |

*Primary Examiner*—Robert J. Spar
*Assistant Examiner*—Ross Weaver
*Attorney, Agent, or Firm*—Phillips, Moore, Weissenberger Lempio & Strabala

[57] ABSTRACT

A pivotally disposable digging-loading bucket for use with earth moving machines comprises a vehicle, a bucket defining a standard cutting edge, and first and second end-wall members; one of said end-wall members being disposed on an attitude angled outwardly of the other end-wall member, and defining a stinger-bit cutting edge thereon. The bracket member is pivotable to bring the standard cutting edge into engagement with a work surface and pivotable to bring the stinger-bit cutting edge into engagement with the work surface, and may be locked in a chosen pivotal attitude.

3 Claims, 3 Drawing Figures

PIVOTALLY DISPOSABLE BUCKET

BACKGROUND OF THE INVENTION

This invention relates to a digging-loading bucket defining a plurality of cutting edges; which bucket is pivotally disposable so as to permit engagement of the chosen cutting edge with a work surface; means to so pivotally dispose the bucket, and means to lock the bucket in the chosen pivotal attitude.

Certain well-known earth moving machines utilize digger-loader buckets to dig and load soil onto other vehicles; some of these machines utilize stinger-bit configurations on selectively engageable cutting edges to dislodge exceptionally compacted soils. These stinger-bit configurations include any one of several well-known means to selectively engage the stinger-bit means with the work surface.

Conventionally, in order to dislodge especially compacted soils, succeedingly larger digging machines or machines equipped with well-known stinger-bit means are brought to the work surface until sufficient ground engaging force can be concentrated to dislodge, for example, virgin soil. This, however, is an inefficient method, and has the undesirable effect of increasing costs of accomplishing various construction projects. (See generally: U.S. Pat. No. 3,238,648 to Cobb et al.)

Certain other side-dump loader buckets are utilized but could not be of general use since they could not be engaged in end-wall cutting. (See U.S. Pat. Nos. 2,924,345 to Bodin and 3,182,831 to Bergmann.)

SUMMARY AND OBJECTS OF THE INVENTION

The object of this invention, therefore, is to provide an effective and readily positionable bucket with both standard cutting edge and stinger-bit cutting edge to dislodge compacted soils.

In accordance with such object, this invention provides a bucket defining a plurality of cutting edges, one of said cutting edges defining a stinger-bit cutting edge, and a device to pivotally dispose said bucket, and means to selectively positionally lock the bucket in a chosen pivotal attitude.

BRIEF DESCRIPTION OF THE DRAWINGS

Other objects of this invention will become apparent from the following description and accompanying drawings wherein.

DESCRIPTION OF THE PREFERRED EMBODIMENT

Figure 1:
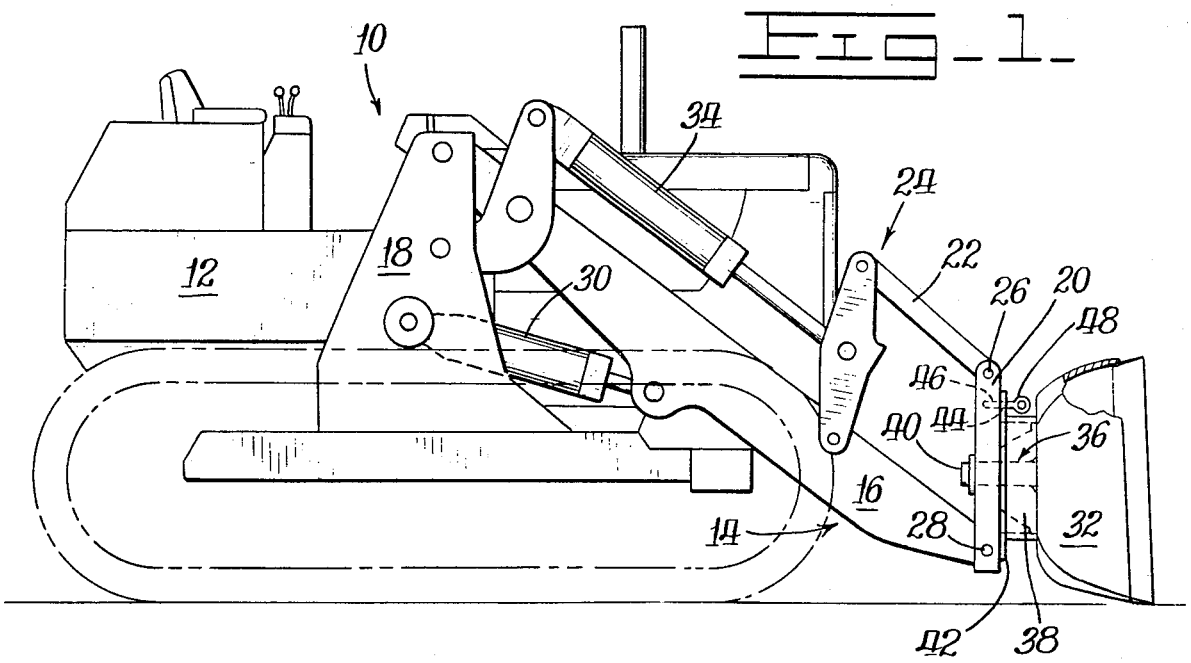
FIG. 1 is a longitudinal view of the invention demonstrating the preferred embodiment of the invention.

With reference to FIG. 1, an earthmoving machine 10 includes a conventional crawler-type operator controlled prime mover vehicle 12, and lift linkage 14 comprising rigid parallel lift arms 16 (only one shown) laterally disposed on a longitudinal axis of the vehicle

12 and positionally adjustably connected to support towers 18 (only one shown) mounted thereto.

A mounting bracket 20 is pivotally and supportingly attached at its upper extremity to two laterally disposed link arms 22 (only one shown in FIG. 1) of a tilt linkage mechanism 24 by pins 26, and to lift arms 16 at their lower extremity by pins 28.

The lift arms 16 are selectively vertically positionable by means of hydraulic jacks 30 (only one shown) movably attached generally intermediate the ends of the lift arms 16 and the support towers 18 on a longitudinal axis thereof to position a digging-loading bucket 32 vertically. The bucket 32 is selectively positionally disposable about a forward and rearward tilt axis relative to pins 28 by means of hydraulic jacks 34 (only one shown) movably attached to the tilt linkage mechanism 24 and support towers 18 on a longitudinal axis thereof.

To assure satisfactory stability and durability for bucket 32, mounting means 36 associated with bracket 20 and bucket 32 are provided. The mounting means 36 comprise a large-diameter-bearing means 38 connected to bucket 32 and having an inner surface defining a bore. Such bore accepts a centrally disposed retaining pin 40 in a pivotal relationship to retain bucket 32 on mounting bracket 20 during the digging-loading operation. The bearing means 38 serve to aid in withstanding high radial loads, and pin 40 operates to retain the bucket 32 axially to bracket 20. Through said mounting means 36 the bucket 32 is pivotable about a pivot axis determined by pin 40.

Means to selectively positionally lock the bucket 32 in a chosen pivotal attitude are included. Such means comprise a coupling member 42 formed integrally with bearing 36 and defining a plurality of bores 44. The mounting bracket 20 defines one or more bores 46 which may be aligned with one or more respective bores 44 in the coupling member 42, upon rotation of the bucket 32 about the pivot axis determined by pin 40. A lock pin 48 (or pins) may be disposed in such aligned bores 44 and 46, respectively, to retain bucket 32 in a chosen pivotal attitude.

One alternative pivotally disposing and locking means would substitute a lever arm for coupling member 42 and would provide complimentary hydraulic actuating means having a locking capacity and suitable mechanism controls in the operator's station of the vehicle 12.

Figure 2:
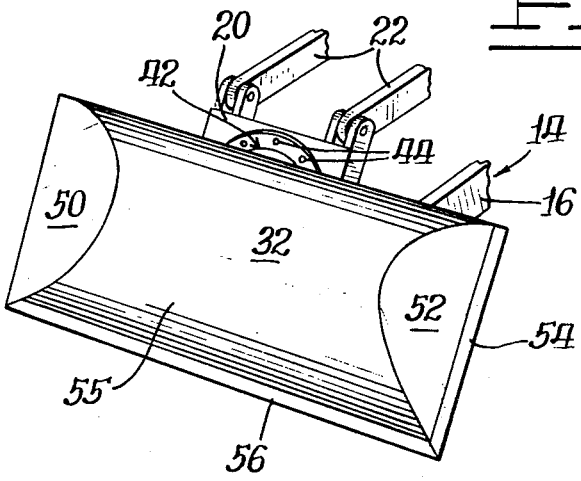
FIG. 2 is an anterior view of the bucket, the mounting bracket and the longitudinal support means (only partly shown) demonstrating the bucket disposed so as to engage the standard cutting edge with the work surface, and further demonstrating the outwardly angled disposition of the end-wall members, and defining the stinger-bit cutting edge thereon.
Figure 3:
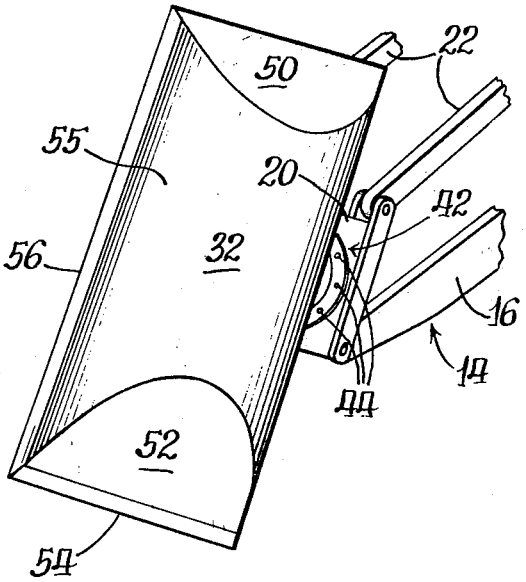
FIG. 3 is an anterior view of the apparatus of FIG. 2, wherein the stinger-bit cutting edge is disposed to engage the work surface.

As will be seen in the anterior of FIGS. 2 and 3, the bucket 32 comprises first and second end-wall members, 50 and 52, respectively; one of said end-wall members 52 defining a stinger-bit cutting edge 54 thereon and describing an outward slope angle relative to the other of said end-wall members 50 in the direction of the stinger-bit cutting edge 54. The bucket 32 further describes a generally convexo-concave body portion 55 and defines a standard cutting edge 56.

The pivot axis of bucket 32 is positioned to allow pivoting of the bucket 32 to allow engagement of the standard cutting edge 56 with a work surface, and to allow pivoting of the bucket 32 to allow engagement of the stinger-bit cutting edge 54 with the work surface.

The mounting means 36, comprising bearing means 38 and pin 40, is situated generally intermediate the end-wall members 50 and 52, respectively. The standard cutting edge 56 of bucket 32 thus extends substantially equally from the mounting means 36 on either side thereof to provide balanced cutting force during engagement of either of the cutting surfaces 54 and 56, respectively, with a work surface. Consequently, equal loading of the motive means of the vehicle 12 results; thus eliminating the tendency for the loader 10 to lose directional control as a result of unbalanced engagement of one of said surfaces 54 and 56, respectively, with the work surface. Sufficient ground clearance to pivotally dispose the bucket 32 on a pivot axis relative to pin 40 is accomplished by means of lift linkage 14. Pivotal disposition of bucket 32 is accomplished by means of mounting means 36 wherein the bucket 32 is pivoted by means of bearing 38 cooperating with pin 40 in the above-described pivotal relationship.

Means to selectively positionally lock the bucket 32 in a chosen pivotal attitude comprise the locking mechanism herein before described.

What is claimed is:

1. In combination with an earthmoving machine including a vehicle having a bucket which includes a standard cutting edge and means interconnecting the bucket and said vehicle, the improvement comprising:

mounting means associated with said bucket and means interconnecting the bucket and vehicle to permit earthmoving operations of the vehicle, said mounting means comprising a bracket operatively connected with the vehicle, bearing means secured to the bucket and defining a bore, and a retaining pin member secured to the bracket and accepted in said bore and engaging said bearing means, so that the bucket may be rotated about an axis of rotation defined by the retaining pin member;

the bucket further comprising first and second end-wall members, one of said end-wall members defining a second cutting edge thereon;

the axis of rotation being positioned to allow rotation of the bucket to a position wherein engagement of the standard cutting edge with a work surface is allowed, and to allow rotation of the bucket to a substantially different position wherein engagement of the second cutting edge with said work surface is allowed;

the mounting means serving to securely mount the bucket to permit the earthmoving operations in both rotative positions; and, means for positionally selectively locking the bucket in both rotational positions.

2. The apparatus of claim 1 wherein the means for positionally selectively locking the bucket in a chosen rotational attitude comprise:

a coupling member mounted relative to the bearing and defining a plurality of bores, and a lock pin positionable in any one of said bores defined by the coupling member and a bore defined by the bracket.

3. The apparatus of claim 2 wherein said second cutting edge comprises a stinger-bit cutting edge.

* * * * *